US006441550B1

(12) United States Patent
Patterson et al.

(10) Patent No.: US 6,441,550 B1
(45) **Date of Patent: *Aug. 27, 2002**

(54) CARBON-BASED FIELD EMISSION ELECTRON DEVICE FOR HIGH CURRENT DENSITY APPLICATIONS

(75) Inventors: Donald E. Patterson, Pearland; Keith D. Jamison, Austin, both of TX (US)

(73) Assignee: Extreme Devices Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/169,908

(22) Filed: Oct. 12, 1998

(51) Int. Cl.[7] ..... H01J 1/62; H01J 63/04

(52) U.S. Cl. ..... 313/495; 313/308; 313/310; 313/311

(58) Field of Search ..... 313/495, 309, 313/310, 311, 306, 308

(56) References Cited

U.S. PATENT DOCUMENTS

| | | | | | |
|---|---|---|---|---|---|
| 3,755,704 | A | | 8/1973 | Spindt et al. | 313/309 |
| 3,789,471 | A | | 2/1974 | Spindt et al. | 445/52 |
| 3,812,559 | A | | 5/1974 | Spindt et al. | 445/52 |
| 4,683,398 | A | * | 7/1987 | Vriens et al. | 313/474 |
| 5,079,476 | A | | 1/1992 | Kane | 313/308 |
| 5,123,039 | A | * | 6/1992 | Shoulders | 378/119 |
| 5,138,237 | A | | 8/1992 | Kane et al. | 315/349 |
| 5,141,460 | A | | 8/1992 | Jaskie et al. | 445/24 |
| 5,180,951 | A | | 1/1993 | Dworsky et al. | 315/169 |
| 5,199,918 | A | | 4/1993 | Kumar | 445/50 |
| 5,602,439 | A | | 2/1997 | Valone | 313/310 |
| 5,619,092 | A | | 4/1997 | Jaskie | 313/309 |
| 5,669,802 | A | * | 9/1997 | Potter | 445/24 |
| 5,686,791 | A | | 11/1997 | Kumar et al. | 313/495 |
| 5,726,524 | A | | 3/1998 | Debe | 313/309 |
| 5,804,909 | A | * | 9/1998 | Nilsson et al. | 313/309 |
| 5,821,680 | A | | 10/1998 | Sullivan et al. | 313/310 |
| 5,834,971 | A | * | 11/1998 | Giguere et al. | 330/43 |
| 5,935,639 | A | | 8/1999 | Sullivan et al. | 427/78 |
| 6,083,068 | A | * | 7/2000 | Kang et al. | 445/24 |
| 6,181,055 | B1 | * | 1/2001 | Patterson et al. | 313/310 |

OTHER PUBLICATIONS

T. Habermann, et al., "Modifying CVD Diamond Films for Field Emission Displays," J. Vac. Sci. Tech. B16, p. 693 (1998).

D.E. Patterson, et al., "Advanced CVD Diamond Microtip Devices for Extreme Applications," Mat. Res. Soc. Symp. Proc., 1998, vol. 509, pp. 65–75.

Charles R. Martin, "Template Synthesis of Polymeric and Metal Microtubules," Advanced Materials, 1991, vol. 3, No. 9, pp. 457–458.

Walt A. deHeer, et al., "A Carbon Nanotube Field–Emission Electron Source," Science, Nov. 17, 1995, vol. 270, pp. 1179–1180.

Robert F. Service, "Nanotubes Show Image–Display Talent," Science, Nov. 17, 1995, vol. 270, p. 1119.

(List continued on next page.)

*Primary Examiner*—Vip Patel
*Assistant Examiner*—Kevin Quarterman
(74) *Attorney, Agent, or Firm*—Baker Botts L.L.P.

(57) ABSTRACT

An electron field emission device is provided by placing a substrate in a reactor, heating the substrate and supplying a mixture of hydrogen and a carbon-containing gas to the reactor while supplying energy to the mixture of gases near the substrate for a time to grow a carbon-based body to a thickness greater than 20 micrometers, subsequently removing the substrate and then applying an electrical contact to one surface of the body. The device is free-standing and can be used as a cold cathode in a variety of electronic devices such as cathode ray tubes, amplifiers and traveling wave tubes. The surface of the substrate may be patterned before growth of the carbon-based body to produce a patterned surface on the field emission device after the substrate is removed.

21 Claims, 6 Drawing Sheets

OTHER PUBLICATIONS

W.P. Kang, et al., "Patterned Polycrystalline Diamond Microtip Vacuum Diode Arrays," Applications of Diamond Films and Related Materials: Third International Conference, 1995, pp. 37–40.

Howard Falk, "Prolog to Vacuum Microelectronic Devices," Proceedings of the IEEE, Jul. 1994, vol. 82, No. 7, p. 1005.

Ivor Brodie and Paul Richard Schwoebel, "Vacuum Microelectronic Devices," Proceedings of the IEEE, Jul. 1994, vol. 82, No. 7, pp. 1006–1034.

Masamitsu Yazawa, et al., "Semiconductor Nanowhiskers," Advanced Materials, 1993, vol. 5, No. 7/8, pp. 577–580.

E.I. Givargizov, et al., "Growth of Diamond Particles on Sharpened Silicon Tips for Field Emission," Applications of Diamond Films and Related Materials: Third International Conference, 1995, pp. 45–47.

G.T. Mearini, et al., "Electron Emission Observations from As–Grown and Vacuum–Coated Chemical Vapor Deposited Diamond," Applications of Diamond Films and Related Materials: Third International Conference, 1995, pp. 61–64.

M.W. Geis, et al., "Diamond Cold Cathodes," Applications of Diamond Films and Related Materials, Elsevier Science Publishers B.V., 1991, pp. 309–310.

T. Roppel, et al, "Thin Film Diamond Microstructure Applications," Applications of Diamond Films and Related Materials, Elsevier Science Publishers B.V., 1991, pp. 311–318.

* cited by examiner

CARBON-BASED FIELD EMISSION ELECTRON DEVICE FOR HIGH CURRENT DENSITY APPLICATIONS

Statement Regarding Federally Sponsored Research or Development

The U.S. Government has a paid-up license in this invention and the right in limited circumstances to require the patent owner to license others on reasonable terms as provide for by the terms of Contract No. F29601-97-C-0117, awarded by the Department of the Air Force.

BACKGROUND OF THE INVENTION

1. Field of the Invention

The present invention relates generally to electron field emitters. More particularly, a device to produce high current densities using field emission and containing a material fabricated from a process employing carbon-containing gas is provided.

2. Description of Related Art

There are two basic geometries of field emission electron devices. The first geometry uses arrays of electron emitting tips. These devices are fabricated using complex photolithographic techniques to form emitting tips that are typically one to several micrometers in height and that have an extremely small radius of curvature. The tips are commonly composed of silicon, molybdenum, tungsten, and/or other refractory metals. Prior art further suggests that microtips can be fabricated from diamond of a specific crystal orientation or that non-carbon microtips can be coated with diamond or a diamond-like carbon to enhance their performance. (U.S. Pat. No. 5,199,918) Also, a class of microtips based on the fabrication of thin wires or whiskers of various materials, including carbon has been described ("Field Emission from Nanotube Bundle Emitters at Low Fields," Q. Wang et al, *App. Phys. Lett.* 70, [24], pp. 3308 (1997)).

The second prior art method of fabricating a field emission device is based upon a low or negative electron affinity surface usually composed of diamond and/or diamond-like carbon (U.S. Pat. No. 5,341,063; U.S. Pat. No. 5,602,439). These devices may be formed into tips or they maybe flat. Other wide bandgap materials (mainly Group III nitrides) have also been suggested as field emission devices due to their negative electron affinity properties.

In the first method, complex lithographic and/or other fabrication techniques are needed to fabricate the tips. Additionally, tips made from non-diamond materials have short functional lifetimes due to resistive heating of the tips and poisoning of the tips due to back-sputtering from the anode. Diamond-based microtips solve those two problems to some degree but typically require many negative electron affinity surfaces in order to function properly.

The second method requires a low or negative electron affinity surface for the devices to work. Additionally, the prior art suggests that an improved diamond or diamond-like emitter can be fabricated by allowing for screw dislocations or other defects in the carbon lattice. (U.S. Pat. No. 5,619,092). Diamond-based materials having maximum current densities up to 10 A/cm$^2$ have recently been described. (T. Habermann, *J. Vac. Sci. Tech.* B16, p. 693 (1998)). These current densities required very high electric fields to turn-on emission, however. The devices were fabricated on and remained on a substrate.

Another very recent paper describes gated and ungated diamond microtips. (D. E. Patterson et al, *Mat. Res. Soc. Symp. Proc.* 509 (1998)). Some ungated emitters were reported to allow electrical current of 7.5 microamps per tip. The process variables used to form the emitters were not discussed. If tips could be formed at a density of $2.5\times10^7$ tips/cm$^2$, it was calculated that the current density could be as high as 175 A/cm$^2$, assuming that all the tips emit and that they emit uniformly.

Different characteristics of field emitters are required for different devices. For some devices, such as flat panel displays, sensors and high-frequency devices, emission at low electric fields is particularly desirable to minimize power requirements. For other devices, higher threshold electric fields for emission are tolerable, but high currents are required. High currents are particularly needed for some applications of electron guns, in amplifiers and in some power supplies, such as magnetrons and klystrons.

Accordingly, a need exists for an improved carbon-based electron emitter that does not involve the fabrication of complex, micrometer-sized (or smaller) structures with tips or structures that require certain crystallographic orientations or specific defects in order to function properly. Additionally, these emitters should provide high levels of emission current at moderate values of electric field for emission. Preferably, the emitters should have a thickness sufficient for the emitter material to have mechanical strength in the absence of a substrate, making free-standing electron sources that are suitable for use in a variety of electronic apparatus.

SUMMARY OF THE INVENTION

In accordance with the present invention, a high current density carbon-based electron emitter is formed by chemical or physical vapor deposition of carbon to form a bulk material. The bulk material or body grown in this manner is believed to provide a high thermal conductivity matrix surrounding conductive carbon channels, so that the resistive heating in the conductive channels, even at high currents, can be dissipated from the channels. Electrons are ultimately emitted from the carbon surface by means of field emission from the conductive channels.

The carbon-based body is formed by chemical or physical vapor deposition. The body is grown by placing a substrate in a reactor, lowering the pressure in the reactor and supplying a mixture of gases that included hydrogen and a carbon-containing gas such as methane at a concentration from about 8 to 13 per cent to the reactor while supplying high energy to the gases near the substrate. The energy may be supplied by several methods, such as a microwave or RF plasma. The substrate is brought to a selected range of temperatures via active heating or cooling of the substrate stage within the reactor. After the carbon-based body has grown to a thickness greater than about 20 micrometers, the substrate is preferably removed, leaving a stand-alone body of carbon-based material. An electrode is placed on one of the surfaces of the material to form the device of this invention. The carbon-based material has a preferred range of electrical resistivity and electron emission from the surface of the material is stable with high current density. The emitting surface may be flat or may be structured if the emitting surface is exposed by removal of the substrate. A structured surface on one side of the carbon-based body is achieved by structuring the surface of the substrate before the growth process begins.

Devices based on high current density electron emission from the carbon-based body are provided. These include electron guns and cathode ray tubes containing the electron guns, amplifiers and traveling wave tubes.

BRIEF DESCRIPTION OF THE DRAWINGS

The foregoing and other objects and advantages of the invention will be apparent from the following written description and from the accompanying drawings in which like numerals indicate like parts.

DESCRIPTION OF THE PREFERRED EMBODIMENTS

Figure 1A:
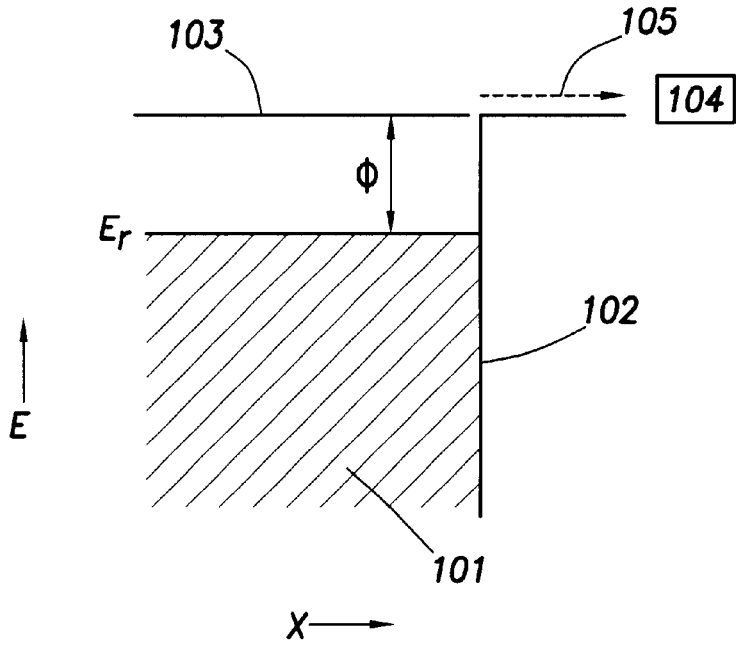
FIGS. 1A and 1B show schematic representations of the physical mechanisms of electron emission by thermionic emission (A) and by field emission (B).

Referring now to FIG. 1A, x is a linear scale measuring the distance across material 101 and reaching potential energy barrier 102 with barrier height 103. A vacuum exists in the region above material 101. E is a linear scale expressing increasing electron energy from the material's conduction band, up through the Fermi level $E_f$, (the highest energy of electrons in the conduction band of the material 101) and further past the energy of the potential barrier height 103, and into a vacuum. The potential energy barrier 102 with height 103 naturally exists and prohibits electrons contained in the conduction band of material 101 from freely escaping into a vacuum. Typically, for electrons in the conduction band of the material 101 to escape into a vacuum, an energy known as the work function, $\phi$, must be supplied to the electrons to allow them to achieve the energy equivalent to the height 103 of the potential barrier 102. The work function, $\phi$, is thus the energy difference between the Fermi energy $E_f$ of the material 101 and the potential energy barrier height 103 (which is also known as the vacuum energy level). If enough energy is supplied to an electron in the material 101 to overcome the work function, $\phi$, then the electrons at the Fermi level $E_f$ will be ejected into vacuum 104. This process is commonly performed by heating the material, and this process is known as thermionic emission, illustrated by electric current 105.

Figure 1B:
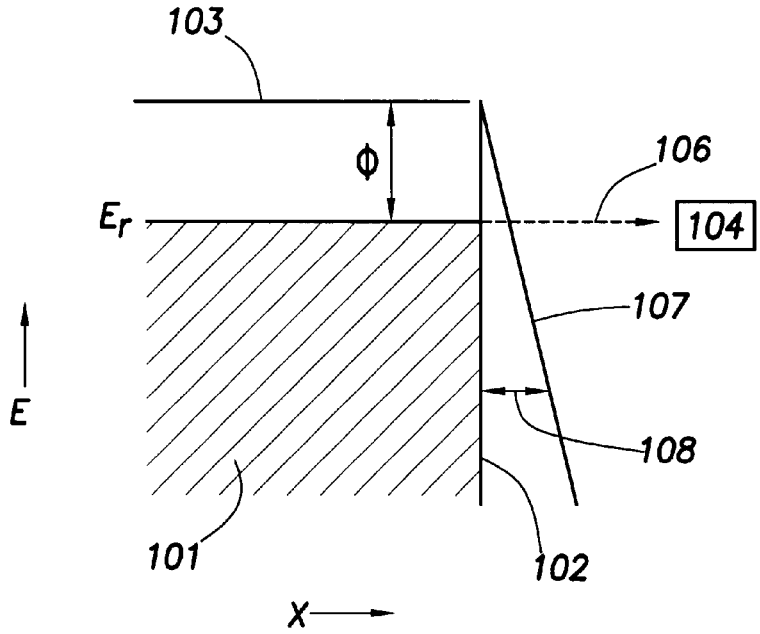

For the present invention, as illustrated in FIG. 1B, a quantum mechanics effect known as field emission, that allows electrons to tunnel through potential barrier 102 into a vacuum, is employed. The bending down of potential barrier height 103 to lower energies 107 is achieved by applying a strong external electric field to potential barrier 102. At distances x close to material 101, the energy of barrier height 103 is bent close to the potential barrier 102 giving potential barrier width 108. At greater distances x away from material 101, potential energy barrier width 108 increases. Field emission of electrons can occur if the potential energy barrier width 108 is narrow enough so that there exists a finite probability of having an electron either in the conduction band of the material 101 or in vacuum. This last phenomenon is due to the Heisenberg Uncertainty Principle. The primary method for decreasing the barrier width 108 is by applying a stronger external electric field. This method is only practical to field strengths of a few hundreds of volts per micrometer for present devices. An alternative method for decreasing the potential barrier width 108 is to provide for sub-micrometer-sized sharp structures, i.e., microtips that enhance the electric field strength at the microtips and create extremely narrow barrier widths 108. Methods described in the prior art use fabricated microtips or whiskers to achieve this outcome. Electron current 106 then flows from the material.

Figure 2A:
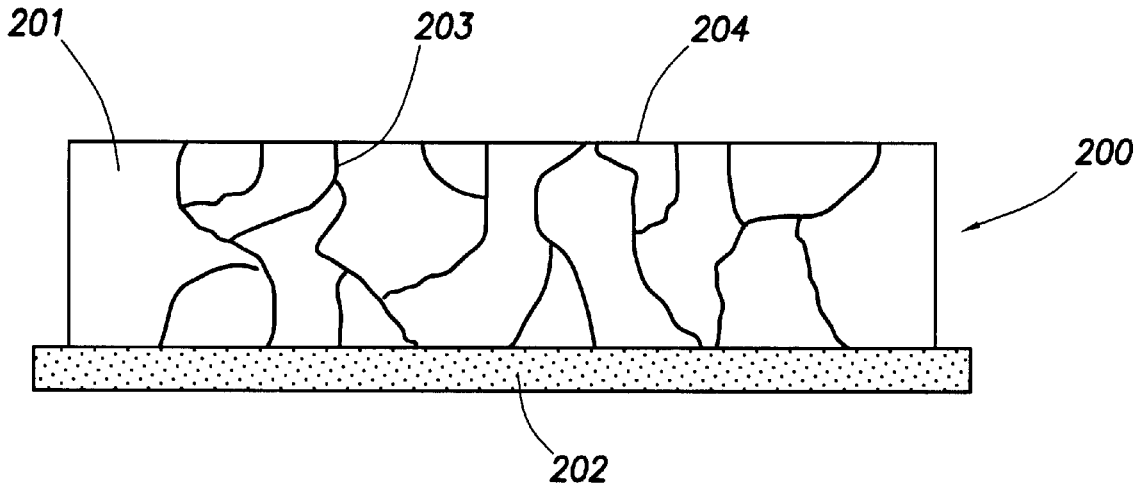
FIGS. 2A and 2B show schematic depictions of a high current carbon-based electron emitter with electrically conductive channels in an insulating, high thermal conductivity carbon structure as formed on a flat substrate (A) and after the substrate is removed and a surface has been covered with an electrical or ohmic contact (B).
Figure 2B:
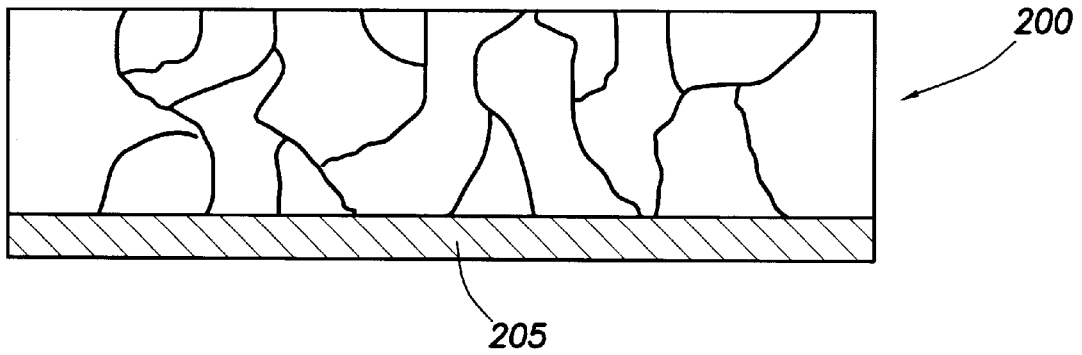

The present invention uses a far less complex method to achieve materials having sub-micrometer-sized features, which are channels of conductive carbon-based material in a matrix of non-conductive carbon-based material. Surprisingly, this material of this invention also achieves electron emission at high levels of current density. FIG. 2A illustrates bulk structure 200 that is believed to be achieved in the present invention. Carbon-based material is deposited on substrate 202 by chemical vapor deposition (CVD) or by physical vapor deposition (PVD) techniques. The carbon-based material is composed of at least 95% carbon atoms with the remainder of the material being comprised of atoms of other elements present in the deposition system. Typical species being present in the material besides carbon include, but are not limited to, hydrogen, nitrogen, and oxygen. Deposition techniques that can be used for the formation of the carbon material include, but are not limited to, microwave CVD, hot-filament CVD, DC plasma arc deposition, flame deposition, cathodic arc deposition, thermal decomposition, and magnetron sputtering. The present invention provides carbon channels 203 having a diameter less than 1 micrometer in matrix material 201. The channels were not observable with electron microscopy. It further provides bulk material 201 having high thermal conductivity. Field emission of electrons is believed to occur at the intersection of conductive channel 203 and the surface 204 when a suitable applied electric field is placed upon surface 204. It is important to note that emission can occur at any surface of the carbon material. The device can be operated as shown in FIG. 2A if substrate 202 is electrically conductive, but preferably substrate 202 is removed from the carbon material by physical and/or chemical means and an electric contact is made to the carbon-based body. The electric contact may replace the substrate or it may be placed on the opposite surface of bulk structure 200, making the surface originally in contact with the substrate the active surface for electron emission. FIG. 2B depicts electrode 205 that has replaced substrate 202. Electrode 205 may be metal deposited to achieve ohmic contact or other conductive materials applied to a surface of carbon-based body 200. Note that electrode 205 may be applied to surface 204 or to the surface originally in contact with substrate 202.

The process of this invention uses high carbon content deposition techniques that avoid the formation of completely $sp^3$ hybridized carbon, as would be the case with the formation of pure diamond films. The process may not use any special treatment of the carbon film designed to create microtips, fibers, whiskers, or any other structure containing a well organized arrangement of carbon atoms. Additionally, the process does not specifically create defects in a diamond and/or diamond-like carbon structure that have been shown in the prior art to yield carbon emitters. The process does include formation of a bulk solid material which is believed to result in creating conductive channels of carbon that randomly penetrate through the bulk of one layer of the carbon material. This form is in contrast to the thin films of carbon-based materials found in the prior art and to the two-layer carbon based material of our concurrently filed patent application titled "Multilayer Carbon-based Field Emission Electron Device for High Current Density Applications."

Figure 3A:
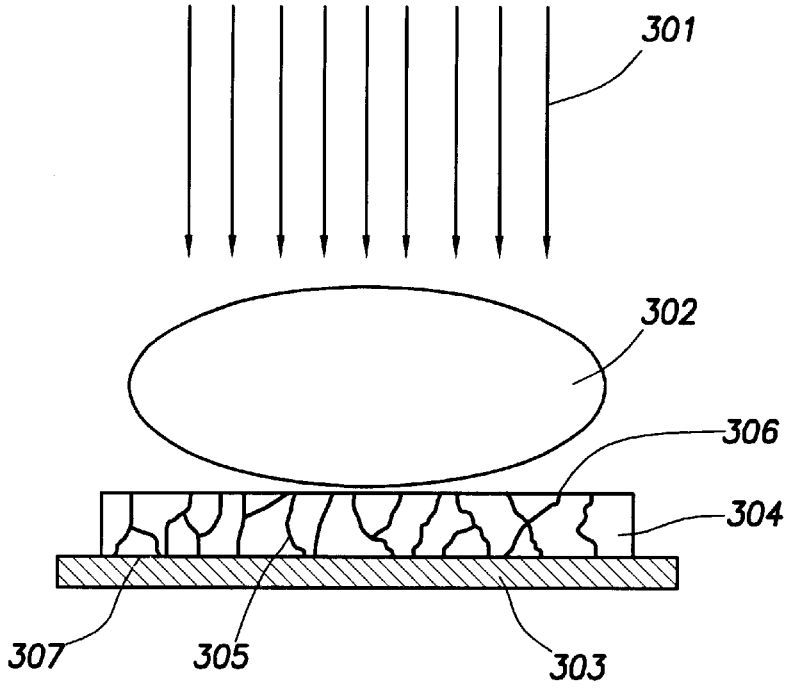
FIGS. 3A and 3B show schematic representations of a method for forming the high current carbon-based electron emitter of this invention on a flat substrate (A) or on a structured substrate (B).

FIG. 3A illustrates the process for forming the material of the present invention. In FIG. 3A, feedstock gas or combination of gases 301 containing a selected amount of carbon atoms is introduced into a vacuum chamber that is maintained in pressure between $10^{-5}$ Torr and 500 Torr. Preferably, the pressure is between 50 Torr and 200 Torr. The feedstock gas contains, by volume, a combination of approximately 85–90% hydrogen, methane gas at a concentration greater than 5% methane up to about 13% methane, and the balance oxygen. Preferably, methane content is greater than 8%, and most preferably methane content is greater than 10% by volume. Typical feedstock gas compositions used in the prior art for generating electron emissive carbon films call for a methane content below about 5%. Although methane is specified herein as the gas of choice for supplying carbon atoms to the system, it should be understood that other carbon-containing species may be used. Some of these carbon-containing precursors include, but are not limited to, ethane, propane, acetone, acetylene, methanol, ethanol and urea. The methane-equivalent amount of carbon atoms would be used for each precursor. If the carbon precursor is not a gas at room temperature, the precursor may be converted into a gas by standard techniques. The gas or gases 301 are then elevated in energy by means of a plasma, hot filament or laser to form gaseous species 302, in which reside carbon-containing ions and/or carbon atoms. The preferred gas activation method is a microwave or RF plasma operating at powers greater than 1 kW. High energy species 302 then impinge upon substrate 303, which is heated to a temperature in the range from about 250° C. to about 1200° C., or preferably in the range from about 600° C. to about 1100° C. Substrate 303 should be chosen from any group of materials that are known carbide-formers, including Si, Mo, and Ti. Additionally, it has been found that a substrate growth surface 307 pretreatment using diamond powder greatly enhances the growth of the carbon-based emitter material. A typical substrate pretreatment uses ultrasonic nucleation of the substrate in a suspension of diamond powder (less than 10 $\mu$m diameter particle size) in methanol for 20 minutes at 50 W power. After 20 minutes, the substrate is removed from the nucleating bath and cleaned of any residual diamond powder. This pretreatment and several other pretreatments for the growth of CVD diamond are known in the prior art. This carbon-rich growth process results in high thermal conductivity carbon-based material 304 with electrically conductive carbon channels 305 penetrating through the material. The emissive carbon-based material is grown to a thickness of at least 20 micrometers, but preferably to a thickness greater than 100 micrometers. Most preferably, the thickness is in the range from about 150 micrometers to about 400 micrometers. These thicknesses provide sufficient strength for the material to be handled as a body after the substrate material is removed. Because of the great thickness of the material, long growth times may be necessary. For example, at a growth rate of 10 micrometers/hour, growth times of more than one day may be necessary to grow a wafer or body of the carbon-based material. Substrates of large size may be used to form large wafers of the material of this invention, however, which can then have the substrate removed, have an electrode applied on one of the surfaces and then be cut or sawed into the size emitter desired.

The material containing 304 and 305 should have an electric resistivity between $1\times10^{-4}$ and $1\times10^{-1}$ ohm-cm and preferably between $1\times10^{-3}$ and $1\times10^{-2}$ ohm-cm. Higher resistivity causes poor emission from the material.

It was found that if the carbon-based material 304 is primarily composed of either diamond and/or diamond-like carbon (containing 95–99% $sp^3$ carbon) then the present invention will have much greater electron emission properties, e.g., longer lifetime, greater emission stability, and higher current density at a given applied electric field. While not wishing to be bound to the present explanation, we believe that, if the material 304 is composed primarily of diamond and/or diamond-like carbon, the extremely high thermal conductivity of the bulk material 304 conducts heat away from carbon channels 305 at a rate which allows the device to be operated at higher current densities and with greater stability over longer time periods than field emission materials of the prior art.

Field emission of electrons is found to occur from a flat surface of the material containing bulk material 304 and channels 305 when a suitable electric field is placed upon that surface, such as surface 306 or the surface originally in contact with substrate 303. Typical threshold electric fields (fields that result in greater than 1 $\mu$A of emission current) are approximately 10 V/$\mu$m. A suitable ground contact must be made to the surface opposite the emission surface. Preferably, substrate 303 is removed, either chemically or mechanically or both, then either surface of the emissive material may be used for emission of electrons. Current densities greater than 10 A/cm$^2$ are achieved from the device at applied electric fields of less than 100 V/micrometer.

Figure 3B:
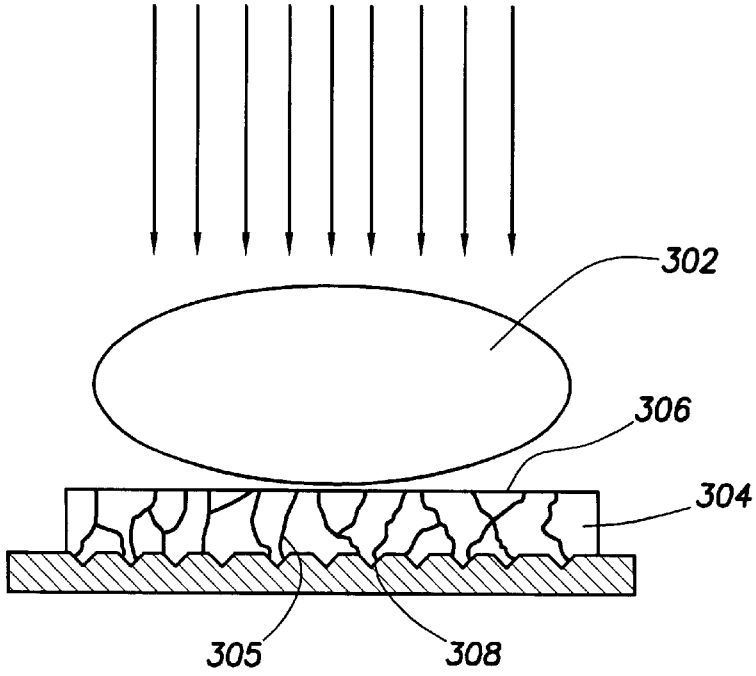

FIG. 3B shows the same process as FIG. 3A except substrate 308 has been structured before the growth process. The substrate may have a structure formed on its surface in a variety of ways. One method is by an anisotropic etch of silicon to form pits in the substrate. The pits then become protrusions in the carbon-based body containing bulk material 304 and channels 305 after the substrate is removed. Other means for structuring the surface include abrasion with diamond dust, laser beams or ion bombardment. The surface of a carbon-based body assumes the shape of substrate surface 308 after growth of the body. After removal of substrate 308, the textured surface of the carbon-based body may be used to decrease the electric field requirements to achieve a selected level of current density during electron emission. The opposite surface from the textured surface is then metallized as described in reference to FIG. 2B.

The material of this invention has use in a variety of applications that require high-power, high-frequency outputs and that will benefit from a cold cathode. The material of this invention is insensitive to effects of radiation and can operate over a temperature range of several hundred degrees Celsius. Some of the applications of this material are electron guns, RF and microwave amplifiers and microwave sources.

Figure 4A:
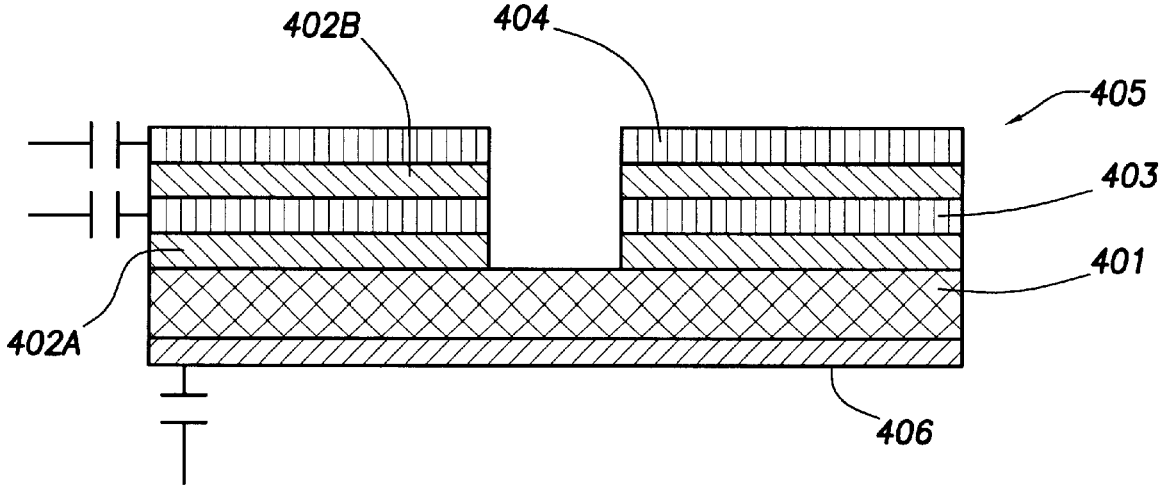
FIGS. 4A and 4B show schematic representations of an electron gun of this invention (A) and of a cathode ray tube including the electron gun (B).

Referring to FIG. 4A, the device of this invention is shown in electron gun 405. Carbon-based emitter 401 has electric contact layer 406 in ohmic contact to form the device of this invention. Layer of carbon-based electron emitter 401 is sequentially covered by a first dielectric layer 402A, electron extraction electrode layer 403, a second dielectric layer 402B and focusing 10 electrode layer 404. Suitable material for the dielectric layers is silicon dioxide or other insulating materials and a metal or other conductive material is suitable for the electrodes.

Methods for fabricating the multiple dielectric and electrode layers and for creating the openings in the layers are those conventionally used in semiconductor fabrication art. It is preferable to create many electron guns on a single carbon wafer before sawing or otherwise dividing the multilayered wafer into separate electron guns. A typical electron gun will contain openings in the layers having a diameter between 1 and 5 micrometers and the openings will have a pitch (distance between centers of openings) in the range from about 10 micrometers to about 20 micrometers. Pitch can be as small as only slightly greater than diameters, but calculations and results indicate pitch should preferably be at least about twice the diameter of openings. For example, an electron gun may contain 1 micrometer openings with a 10 micrometer pitch in a 100×100 array of openings, or 10,000 openings. Still, thousands of electron guns can be produced on a single 2-inch diameter or larger carbon wafer.

Figure 4B:
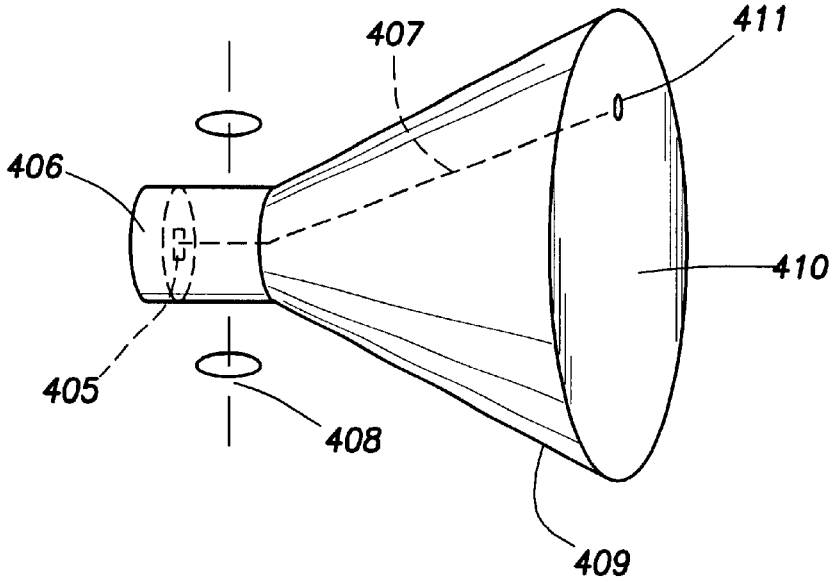

FIG. 4B shows the electron gun of FIG. 4A in a cathode ray tube (CRT). Referring to FIG. 4B, electron gun 405 is mounted on electrical connection base 406 of the CRT. Electron gun 405 generates electron beam 407 when suitable power is applied to the device. The beam is steered by magnetic deflection coils 408 located outside CRT housing 409 and directed to strike phosphor screen 410 to produce image 411. The electron gun of this invention is particularly appealing because of the high output current density of the carbon-based emitter of this invention and the small size of the electron gun. The CRT may be such as those in television sets and computer monitors. Additionally, the electron gun can be used in many scientific instruments such as scanning electron microscopes and Auger electron spectrometers. Electron guns incorporating the material of this invention will have a higher brightness, smaller spot size and higher frequency of operation than electron guns of the prior art. This development makes possible brighter, higher resolution CRTs. As carbon-based cold cathodes emit electrons immediately when the proper electric field is applied, CRTs using them will turn-on instantaneously. Prior art CRTs using thermionic electron guns require a significant warm-up time if they are not constantly drawing electrical current through a filament or other thermionic electron emitter. Other advantages of using the carbon-based emitter of this invention in an electron gun are: longer life of the gun, greater stability of the electron beam and lower fabrication costs.

Figure 5:
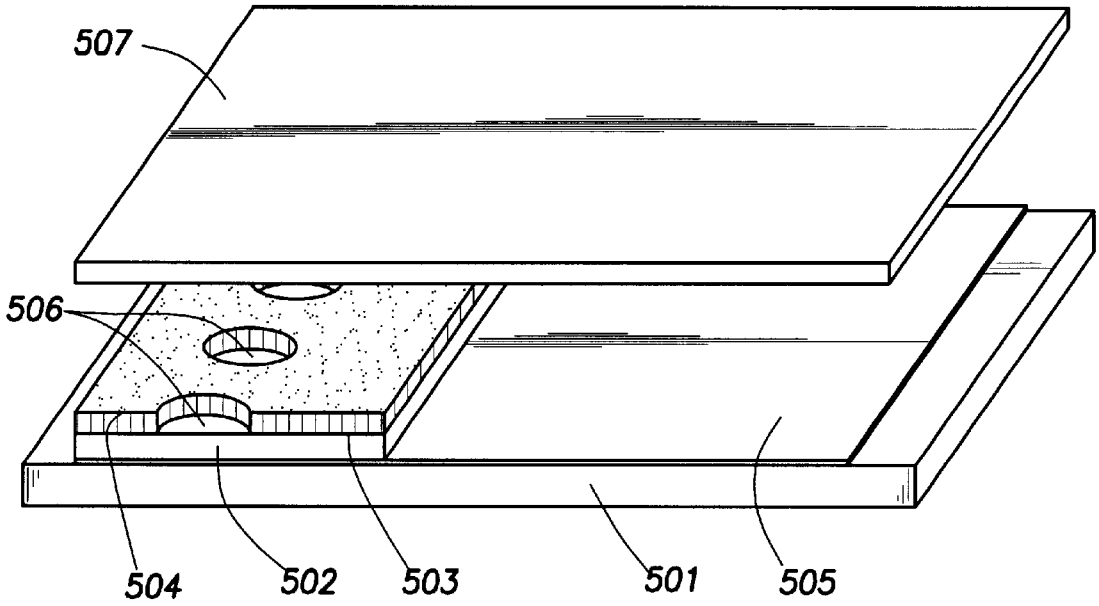
FIG. 5 shows a schematic representation of an amplifier of this invention.

The high current characteristic of the present material will also prove advantageous in RF and microwave amplifiers. Amplifiers will exhibit greater amplification power in smaller, lighter packages. A sketch of a high-frequency amplifier employing the material of the present invention is shown in FIG. 5. In this amplifier, insulating base 501 has conductive ground plane 505 composed of a metal or other conductive material deposited or attached to base 501. As a separate entity, a cold cathode emitter is formed by fabricating the carbon-based emitter 502 of the present invention, depositing a dielectric layer 503 onto emitter 502, and finally depositing a conductive gate layer 504 upon the dielectric layer 503. Micrometer-sized holes 506 are subsequently opened in the gate layer and the dielectric layers using standard semiconductor fabrication techniques. The method of fabrication of this cold cathode is similar to that previously discussed for making an electron gun. The gated cold cathode 502/503/504/506 is attached to ground plane 505 by an electrically conductive adhesive such as conductive epoxy and anode 507 is placed at a selected distance apart from the base assembly to collect electrons. When the device is operational, a control signal is placed between ground plane 505 and cold cathode gate 504 and an amplified signal is generated between ground plane 505 and anode 507.

Figure 6:
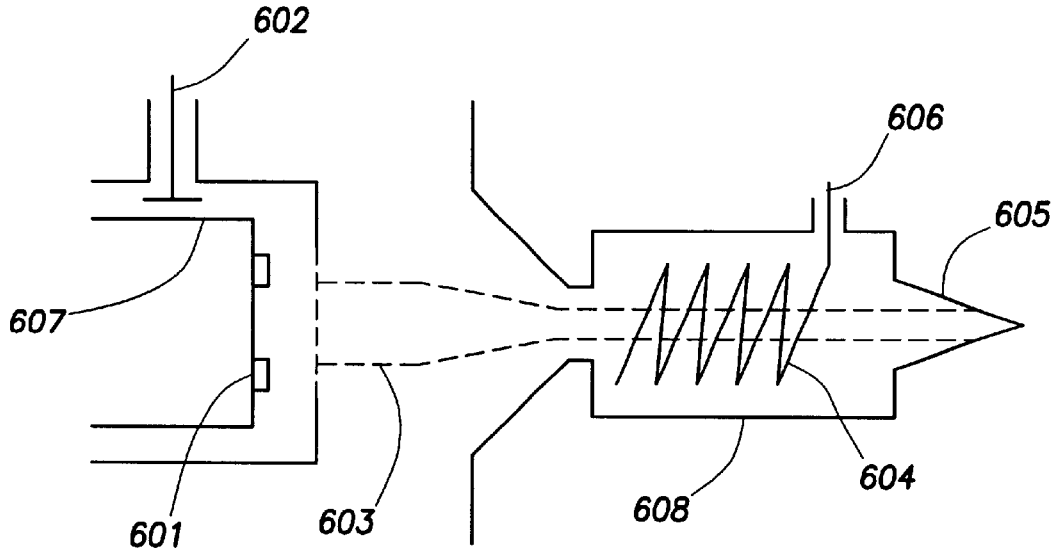
FIG. 6 shows a schematic representation of a traveling wave tube of this invention.

FIG. 6 shows a schematic of a traveling wave tube (TWT), a standard microwave generating device, incorporating the electron gun of the present invention. In this device, electrons are extracted from carbon-based emitter of this invention 601 by providing an RF excitation potential via input signal electrode 602 with respect to emitter base 607, which is DC-biased with respect to electrode 602. The emitted electrons are produced in pulsed beam 603 at the drive frequency of the signal input on electrode 602. Pulsed beam 603 is accelerated by high voltage and focused through helix 604 onto beam dump 605. Pulsed beam 603 inductively couples with helix 604, creating an amplified output signal (RF power) at output electrode 606. The device is enclosed in envelope 608. Advantages of TWTs using the present carbon-based electron source include superior efficiencies and higher power-to-weight ratios.

The carbon-based material of this invention is more particularly described by the following examples. The examples are intended as illustrative only and numerous variations and modifications will be apparent to those skilled in the art.

EXAMPLE 1

Referring again to FIG. 3A, silicon substrate 303 was pre-treated before carbon growth by immersion in a diamond powder and methanol suspension (0.1 g. 1 $\mu$m diamond powder in 100 ml. methanol) and subjected to ultrasonic vibration (50 W) for 20 minutes. Any residual diamond/methanol left on substrate 303 after sonification was removed by using a methanol rinse. Substrate 303 was then dried with dry nitrogen and introduced into a commercial microwave chemical vapor deposition system (ASTeX AX5400). Gas mixture 301, composed of 87% hydrogen, 11% methane, and 2% oxygen, was subsequently introduced into the reactor using gas flow rates of 532 sccm hydrogen, 70 sccm methane, and 9 sccm oxygen. The system was held at a constant pressure of 115 Torr. Microwave plasma 302 was ignited and maintained at 5 kW. Substrate 303 was held in a water-cooled molybdenum holder and raised into the plasma to maintain a deposition temperature between 900° C. and 1050° C. Carbon-based layer 304 was deposited onto substrate 303 for 22 hours, resulting in a material thickness of approximately 165 micrometers. The material had a resistivity of $8.25\times10^{-2}$ ohm-cm.

Figure 7:
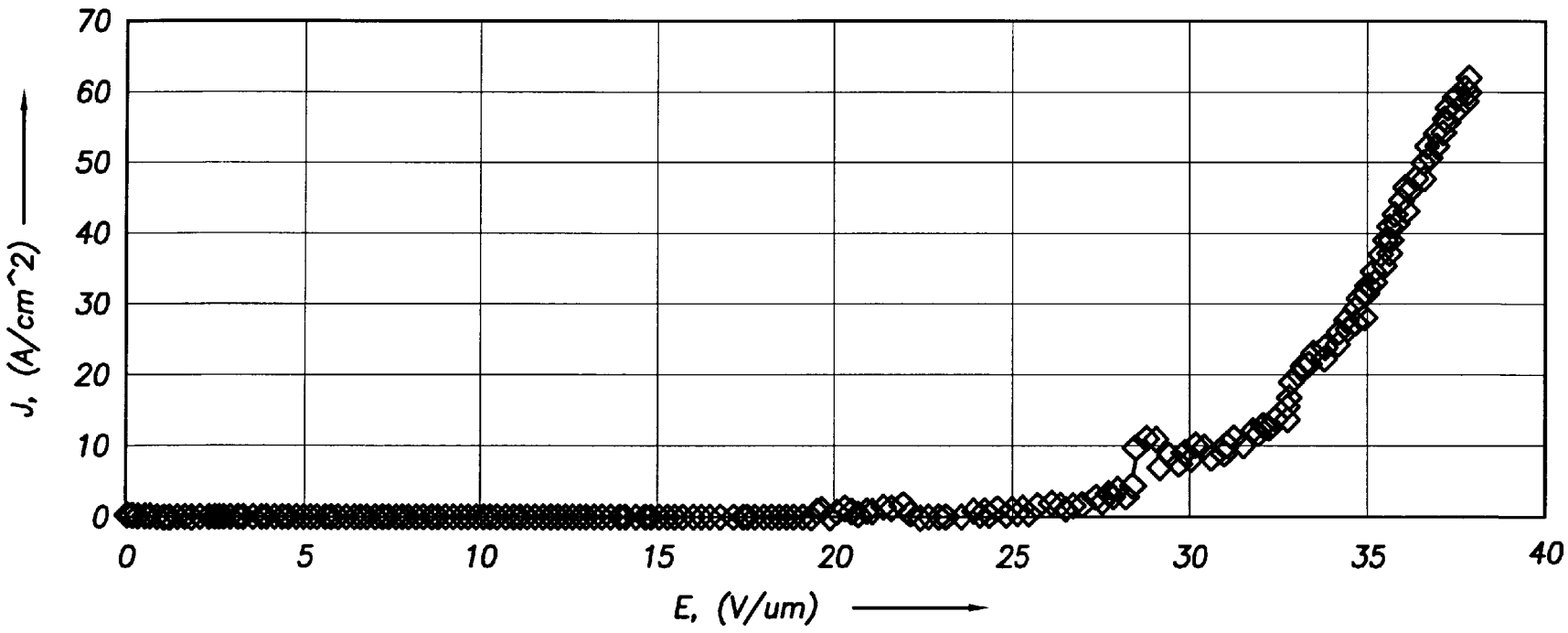
FIG. 7 is a graph of current vs. applied field for one embodiment of the material of this invention.

For device testing, substrate 303 was chemically removed and an electrical contact placed over growth surface 306. The material was free-standing or self-supporting and had sufficient mechanical strength to be handled as a component of an electric device. The device was then placed into a test chamber with a vacuum of $5\times10^{-7}$ Torr in contact with active surface 307. A separate electrode was brought to within approximately 20 micrometers of active surface 307 and an electric field was generated upon surface 307 by applying a positive electric potential to the opposing electrode. The emitting film in this configuration was capable of producing 2.5 $\mu$A current over a 4 $\mu m^2$ area (a current density of 62.5 A/cm$^2$) at an applied electric field of 38 V/$\mu$m. The curve of current density as a function of electric field is shown in FIG. 7. Electric current was withdrawn from the sample for a period of several hours without failure, indicating the stability of the high-current device of this invention.

EXAMPLE 2

The same procedure as that given in EXAMPLE 1 was followed except that a gas composition of 86% $H_2$, 10% $CH_4$, and 4% $O_2$ (532 sccm $H_2$, 60 sccm $CH_4$, and 9 sccm $O_2$) was used. The emitting carbon film was grown for 21 hours resulting in a film thickness of 175 micrometers. This film had a resistivity of $1.23\times10^{-1}$ ohm-cm and was capable of producing a current density of 77 A/cm$^2$ at an applied field of 53 V/$\mu$m.

Although the present invention has been described with reference to specific details, it is not intended that such details should be regarded as limitations upon the scope of the invention, except as and to the extent that they are included in the accompanying claims.

What we claim is:

1. An electron field emission device, comprising:

a carbon-based body having a thickness greater than about 20 micrometers formed by placing a substrate in a reactor at a selected pressure and bringing the substrate to a selected range of temperature and supplying a mixture of gases comprising a carbon-containing gas and hydrogen to the reactor while supplying energy to the mixture of gases near the substrate for a time sufficient to grow the body and subsequently removing the substrate from the body; and an electrical contact to the body.

2. The device of claim 1 wherein the body has a thickness greater than 100 micrometers.

3. The device of claim 1 wherein the body has a thickness greater than 150 micrometers.

4. The device of claim 1 wherein the mixture of gases comprises methane or a hydrocarbon gas having carbon atoms equivalent to methane at a volume concentration between about 5 per cent and about 13 per cent methane.

5. The device of claim 1 wherein the mixture of gases comprises methane or a hydrocarbon gas having carbon atoms equivalent to methane at a volume concentration between about 8 per cent and about 12 per cent methane.

6. The device of claim 1 wherein the mixture of gases comprises methane or a hydrocarbon gas having carbon atoms equivalent to methane at a volume concentration greater than about 10 per cent methane.

7. The device of claim 1 wherein the mixture of gases further comprises oxygen.

8. The device of claim 1 wherein the substrate is selected from materials consisting of carbide-forming materials.

9. The device of claim 1 wherein the pressure in the reactor is in the range from about $1\times10^{-5}$ Torr to about 500 Torr.

10. The device of claim 1 wherein the pressure in the reactor is in the range from about 50 Torr to about 200 Torr.

11. The device of claim 1 wherein the temperature of the substrate is in the range from about 600° C. to about 1100° C.

12. The device of claim 1 wherein the energy is supplied to the mixture of gases by the method of microwave or RF plasma.

13. The device of claim 12 wherein the energy is supplied at a power level greater than 1 kilowatt.

14. The device of claim 1 wherein the carbon-based body has an electrical resistivity between about $1\times10^{-4}$ and $1\times10^{-1}$ ohm-cm.

15. The device of claim 1 wherein the carbon-based body has an electrical resistivity between about $1\times10^{-3}$ and $1\times10^{-2}$ ohm-cm.

16. The device of claim 1 wherein the current density from the device is greater than 10 A/cm$^2$ in the presence of applied electric fields less than 100 volts/micrometer.

17. The device of claim 1 wherein the substrate has been patterned on its surface to a selected shape before it is placed in the reactor.

18. An electron gun, comprising:

a carbon-based body having a thickness greater than about 20 micrometers formed by placing a substrate in a reactor at a selected pressure and bringing the substrate to a selected range of temperature and supplying a mixture of gases comprising a carbon-containing gas and hydrogen to the reactor while supplying energy to the mixture of gases near the substrate for a time sufficient to grow the body and then removing the substrate;

a first dielectric layer on the carbon-based body;

a first and a second electrode, the electrodes being separated by a second dielectric layer; and electrical contacts to the carbon-based body and the electrodes.

19. A cathode ray tube, comprising:

an electron gun, the electron gun comprising a carbon-based body having a thickness greater than about 20 micrometers formed by placing a substrate in a reactor at a selected pressure and supplying a mixture of gases comprising a carbon-containing gas and hydrogen to the reactor while supplying energy to the mixture of gas near the substrate for a time sufficient to grow the body and then removing the substrate, a first dielectric layer on the carbon-based body, a first and a second electrode, the electrodes being separated by a second dielectric layer, and electrical contacts to the carbon-based body and the electrodes;

a housing;

a base for electrical connections;

deflection coils; and a phosphor screen.

20. A high-frequency amplifier, comprising:

an insulating base;

a carbon-based body having a thickness greater than about 20 micrometers formed by placing a substrate in a reactor at a selected pressure and bringing the substrate to a selected temperature range and supplying a mixture of gases comprising a carbon-containing gas and hydrogen to the reactor while supplying energy to the mixture of gas near the substrate for a time sufficient to grow the body and subsequently removing the substrate;

a dielectric layer;

an electron extraction electrode;

a conducting ground plane; and an anode.

21. A traveling wave tube, comprising:

a carbon-based body having a thickness greater than about 20 micrometers formed by placing a substrate in a reactor at a selected pressure and bringing the substrate to a selected range of temperature and supplying a mixture of gases comprising a carbon-containing gas and hydrogen to the reactor while supplying energy to the mixture of gas near the substrate for a time sufficient to grow the body and subsequently removing the substrate;

a means for signal input;

an electron extraction electrode;

a helix means for signal output; and a beam dump.

* * * * *